United States Patent [19]

Gilkerson

[11] 4,255,875

[45] Mar. 17, 1981

[54] SHOE WITH SUPPORTIVE GIRDLE LINER

[76] Inventor: Francis M. Gilkerson, P.O. Box 292, Mount Vernon, Mo. 65712

[21] Appl. No.: 967,133

[22] Filed: Dec. 7, 1978

[51] Int. Cl.[3] ..... A43B 23/07

[52] U.S. Cl. ..... 36/55; 36/77 R

[58] Field of Search ..... 36/55, 77 R, 77 M, 3 A, 36/55, 77 R, 77 M, 3 A

[56] References Cited

U.S. PATENT DOCUMENTS

| | | | |
|---|---|---|---|
| 1,604,355 | 10/1926 | Killalee | 36/55 |
| 2,124,727 | 7/1938 | Bown | 36/77 R |
| 2,180,996 | 11/1939 | Prewitt | 36/55 |
| 2,186,589 | 1/1940 | Lovell | 36/77 R |
| 2,651,854 | 9/1953 | Taber et al. | 36/3 A |

FOREIGN PATENT DOCUMENTS

| | | | |
|---|---|---|---|
| 121948 | 8/1946 | Australia | 36/55 |
| 18753 | of 1900 | United Kingdom | 36/55 |

*Primary Examiner*—James Kee Chi

*Attorney, Agent, or Firm*—Rogers, Eilers & Howell

[57] ABSTRACT

A shoe having a partial liner is disclosed. The shoe is unlined single thickness leather having a partial leather girdle in the interior. The girdle is of reduced thickness and extends transversely across the foot from sole edge to sole edge and from a point just behind the box toe or toe stiffening area of the shoe to a point slightly behind the bunion joint portion of the foot, that is, to the longitudinal arch area. The girdle is skived at the periphery to prevent its being visible from outside the shoe. The girdle may be perforated on all or a portion of its surface to facilitate cooling of the foot. The perforations may extend entirely through the shoe for additional cooling. The girdle is placed with the grain side of the leather next to the foot and is oriented so that the stretch of the girdle is transverse to the stretch of the vamp of the shoe. Normally the maximum stretch of the girdle is longitudinal to the shoe and the maximum stretch of the vamp is transverse of the shoe.

10 Claims, 5 Drawing Figures

FIG. 1.
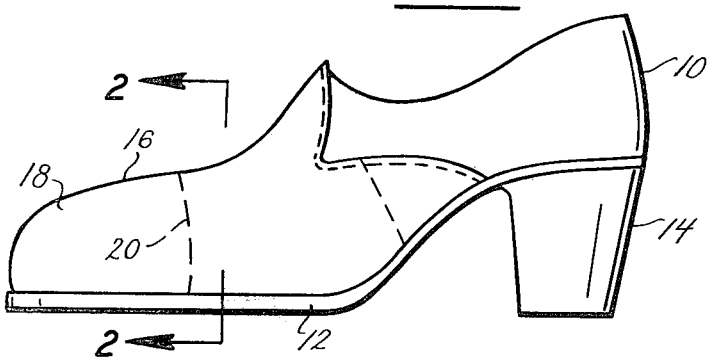
FIG. 2.
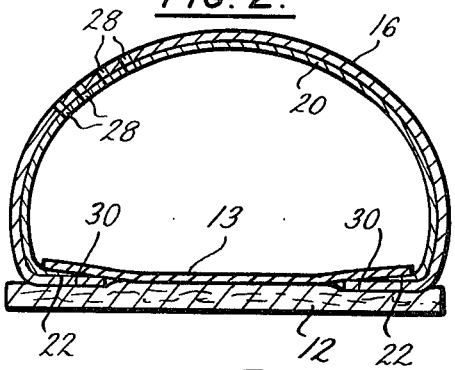
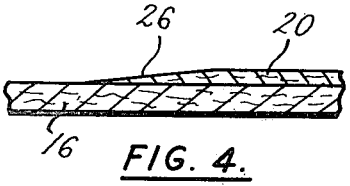
FIG. 4.
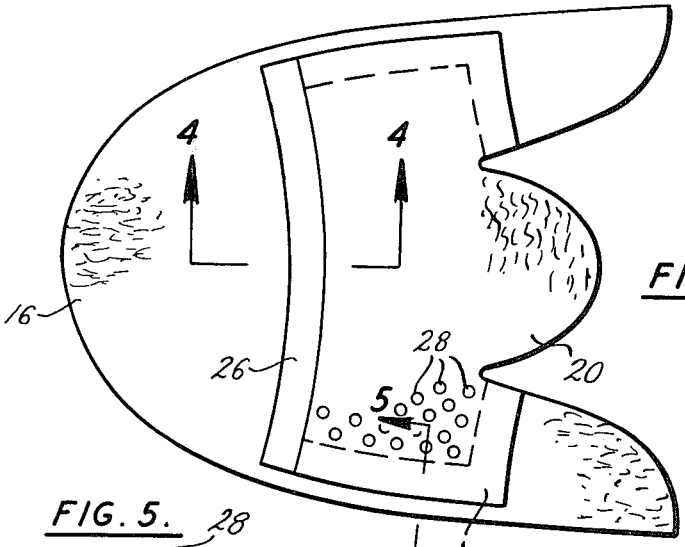
FIG. 3.
FIG. 5.
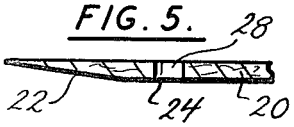

SHOE WITH SUPPORTIVE GIRDLE LINER

BACKGROUND AND SUMMARY OF THE INVENTION

It is often desired to make the vamp, or upper portion of shoes from lightweight materials, since the thinner materials are more flexible and are cooler to wear. Often the shoes are unlined, to maximize these properties. However, it has been found that unlined leather shoes, particularly those made with the flesh side of the leather in the interior of the shoe, tend to catch or hold stockings of the wearer when the foot is inserted in the shoe. The leather may hold on to the stockings, creating wrinkles and sometimes pulling holes in the stockings.

In addition, the unlined leather shoe provides very little support to the foot and is free to stretch. In a very short time the shoe can stretch so that it loses its desired shape and esthetic appeal.

Applicant has conducted a search and has found the following references which disclosed lined shoes. The disclosures of the following are incorporated by reference herein. U.S. Pat. No. 1,533,668; U.S. Pat. No. 1,604,355; U.S. Pat. No. 2,088,158; U.S. Pat. No. 2,411,479; U.S. Pat. No. 2,578,987 and U.S. Pat. No. 2,618,870.

Applicant has devised a shoe which can be light in weight and can use a single layer of leather throughout a substantial portion of the vamp of the shoe to achieve comfort and lightness in weight of the shoe typical of an unlined shoe, but provides the support to the shoe in the metatarsal area and resists distortion substantially as does a lined shoe. In addition, a smooth inner surface can be provided on the foot side of the shoe which will not wrinkle, pull or catch on to stockings on the feet of the wearer.

These and other advantages will be apparent from the description of the preferred embodiments and from the drawings.

DESCRIPTION OF THE DRAWINGS

FIG. 1 is a side view of a shoe having applicant's girdle and support;

FIG. 2 is a cross-sectional view of the shoe in FIG. 1 taken along the plane of lines 2—2;

FIG. 3 is a bottom view of a vamp blank for the shoe of FIG. 1;

FIG. 4 is a partial cross-sectional view of the vamp blank of FIG. 3 taken along the plane of lines 4—4;

FIG. 5 is a partial cross-sectional view of the girdle and support.

DESCRIPTION OF THE PREFERRED EMBODIMENTS

Referring in more detail to the drawings, FIG. 1 shows a shoe 10 having a sole 12, insole 13 and heel 14. The shoe 10 has a vamp portion 16 attached to sole 12, the vamp portion 16 has a box toe area 18, though the box toe reinforcing is not shown. In the mid area of the shoe is a leather girdle 20 shown in phantom in FIG. 1. The girdle 20 is formed of leather and has a skived portion 22 around its periphery. The girdle 20 is bonded to the inside of the vamp 16 by a conventional adhesive, not shown, with the grain side of the leather of the girdle 20 faced toward the foot side of the shoe. The flesh side of the leather of girdle 20 is bonded to the flesh side of the leather of vamp 16, as shown. Girdle 20 is formed of leather and extends the entire circumferential distance around the foot of the wearer of shoe 10 from under the sole edge to under the sole edge, as shown, reinforcing the vamp 16, providing additional support to the vamp 16 and providing additional support for the foot of the wearer.

The leather of vamp 16 is normally oriented so that the stretch of the leather is tightest from toe to heel of the shoe and most elastic circumferentially around the foot. In this construction, the vamp leather tends to stretch out of shape circumferentially and lose its aesthetic appearance and supporting capabilities for the foot of the wearer as the shoe is worn. To retard the stretch of the vamp 16, the leather of girdle 20 is chosen and oriented so that the direction of greatest elasticity is toe to the heel and the greatest resistance to stretch is oriented circumferentially around the foot of the wearer. This provides transverse reinforcement of the vamp 16 against stretching of the leather and loss of shape and aesthetic qualities. Girdle 20 also provides additional stiffening and support for the foot of the wearer.

A peripheral area 22 around the girdle 20 is skived to provide an area of additional flexibility at the periphery. The skiving is shown as being on the flesh side 24 of the girdle 20, along three edges of the girdle 20. An additional area 26 can be skived at the toe side of the girdle 20, on the grain portion of the girdle 20, to provide an area suitable for bonding to a box toe member, not shown. The flexibility provided by the skived areas prevents the outline of girdle 20 from being visible from the exterior of the shoe 10 as would be the case if a stiff square edge were allowed to remain on the girdle 20.

The girdle 20 is normally split or reduced to be thinner than the leather piece used to make vamp 16, preferably the girdle is one half or less of the thickness of the vamp 16 to preserve the flexibility of the vamp 16 and to retain the cool qualities of the shoe. If desired, the girdle may have perforations 28 over part or all of its surface to facilitate cooling. The perforations 28 may also pass through the vamp 16, if maximum cooling is desired.

As shown in FIG. 2 the shoe is formed with the vamp 16 curved to the shape of the foot with girdle 20 on the inside or foot side of the vamp 16. The edges of vamp 16 are brought over and bonded to a relieved portion 30 of sole 12 by a suitable adhesive, not shown. The insole 13 has been bonded to the interior of sole 12 and covers the bonded areas of vamp 16, as shown, forming a smooth interior surface in the shoe. The girdle 20 extends from a point adjacent the insole 13 around the interior of vamp 16 to a point adjacent the insole 13 at the opposite edge of the insole 13.

The shoe 10, vamp 16 and girdle 20, and including the heel and heel counter, is joined by conventional techniques, as is known by those in the art. If hard toes are desired in the shoe 10, a box toe, not shown, may be applied to the interior of the box toe portion 18 of the shoe 10 to provide additional stiffness to the toe area. The box toe is joined by conventional glue techniques, as known in the art, and can include overlapping a skived portion of the boxed toe with the skived portion 26 of girdle 20 to provide a smooth joint and a tight bond between the girdle 20, the vamp 16 and the box toe portion. To improve the bond between the box toe and the girdle 20, the skive 26 is made on the grain side of the leather to provide a better surface for bonding. The remainder of the girdle 20 that is contacted by the foot is the grain portion of the leather. The better bonding flesh side is tightly bonded to the flesh side of vamp 16. The grain portion of girdle 20 will resist pulling, sticking and wrinkling of stockings on the foot of the wearer. Girdle 20 can also reinforce the portions where the heel counter and other parts of the upper of the shoe are joined to the vamp by providing an additional bit of thickness and stiffening where those portions are joined by sewing. Girdle 20 can be extended onto the tongue of shoe 10 to line the tongue of the shoe 10, if desired for some shoe styles such as oxfords.

It will be appreciated that by using leather applicant has used a material similar to that used for construction of the upper of shoe 10 and vamp 16 so that the properties of the two materials are highly compatable. Due to the small size of the girdle 20 it can be cut from scrap material or offal which would normally be wasted in the shoe making process and is thus a considerable savings in materials required for construction of the shoe 10. In addition, by tightly bonding and orienting the elastic properties of the leather of girdle 20 in a transverse direction to the elastic properties of the leather of vamp 16, a very strong structure is provided in the shoe upper which provides support for the foot of the wearer and allows the shoe to retain its shape and aesthetic appearance for a much longer time in use. The shoe also retains its elastic properties in use due to the compatable nature of the materials of girdle 20 and vamp 16 so that the flexibility and comfort of the shoe is not impaired by the presence of girdle 20. Due to the small area covered by the girdle, the cooling properties of the shoe are not impaired and the shoe remains comfortable on the foot of the wearer.

In the foregoing specification I set forth the embodiments described herein for the purposes of illustration, but it is to be understood that such details may be varied widely by those skilled in the art without departing from the scope of the invention.

I claim:

1. A shoe having an upper, means inside a portion of the upper and compatable with the material of the upper resisting stretching of the upper and retaining the shape and appearance of the upper, the means providing additional support for the foot of the wearer and retaining flexibility of the shoe, the shoe having means to prevent lining of the outer portion of the upper in the area of the compatable means, the compatable means extending around the metatarsal area of the shoe, the shoe further having means forming a sole and heel.

2. The shoe of claim 1 wherein the upper is leather and the interior compatable means is a shaped leather girdle.

3. The shoe of claim 2 wherein the elastic properties of the leather girdle are oriented transverse to the elastic properties of the upper.

4. The shoe of claim 3 wherein the elastic properties of the girdle in its most elastic direction are oriented from front to rear of the shoe and the elastic properties of the upper are oriented with the most elastic direction transverse to the shoe.

5. The shoe of claim 2 wherein the grain side of the leather girdle is positioned in the interior of the shoe and the flesh side is joined to the upper.

6. The shoe of claim 1 wherein the compatable means is perforated.

7. The shoe of claim 1 wherein the shoe and the compatable means are perforated.

8. The shoe of claim 1 wherein the compatable means is no more than about one half of the thickness of the upper and wherein the periphery of the compatable means is skived to increase the flexibility of the means, to retain the flexibility of the shoe containing the compatable means and to resist the lining tendency of the upper around the periphery of the compatable means.

9. The shoe of claim 8 wherein the forward portion of the compatable means is skived at its forward edge for joining with a box toe on the interior of the shoe.

10. A shoe having an upper of thin leather, the upper having a vamp portion, a leather girdle inside the upper extending across a portion of the vamp and being compatable with the leather of the vamp, the girdle being tightly bonded to the vamp, the girdle being also of thin leather of no more than about one-half of the thickness of the upper, the leather of the vamp portion being oriented with the dimension of minimum stretch in the toe to heel direction of the shoe and the leather of the girdle being oriented with the dimension of minimum stretch transverse to that of the vamp, the girdle and vamp each being perforated through at least a portion thereof, the girdle being positioned with the grain side of the leather to the interior of the shoe and with the flesh side of the girdle joined to the vamp of the upper, the vamp being positioned with the grain side to the outside of the shoe, the girdle being skived throughout at least a portion of its periphery to increase the flexibility and to prevent lining of the upper around the periphery of the girdle, the girdle extending in a transverse direction from sole edge to sole edge of the shoe and from a position slightly adjacent the toe area of the shoe to a position behind the bunion joint area of the shoe, the girdle resisting stretching of the vamp and providing additional support to the vamp circumferentially around the front portion of the foot of the wearer of the shoe and retaining the shape and aesthetic qualities of the shoe.

* * * * *